United States Patent [19]

Watson

[11] 4,164,082

[45] Aug. 14, 1979

[54] EXCAVATOR FOR ANCHOR HOLES

[76] Inventor: Gary Q. Watson, P.O. Box F, Del Rio, Tex. 78840

[21] Appl. No.: 840,972

[22] Filed: Oct. 11, 1977

[51] Int. Cl.[2] ..... E02F 5/06; E02F 3/14

[52] U.S. Cl. ..... 37/83; 37/191 A; 52/166; 405/259

[58] Field of Search ..... 37/83–90, 37/191 R, 191 A, 192 R, 192 A

[56] References Cited

U.S. PATENT DOCUMENTS

| | | | |
|---|---|---|---|
| 3,022,585 | 2/1962 | Bradley | 37/90 X |
| 3,099,098 | 7/1963 | Davis | 37/86 |
| 3,266,179 | 8/1966 | Golden | 37/86 |
| 3,388,487 | 6/1968 | Peck | 37/90 |
| 3,603,010 | 9/1971 | Polinek | 37/83 |
| 3,659,364 | 5/1972 | Wilson | 37/83 |

FOREIGN PATENT DOCUMENTS

| | | | |
|---|---|---|---|
| 1364033 | 5/1964 | France | 37/90 |

*Primary Examiner*—Clifford D. Crowder
*Attorney, Agent, or Firm*—Wendell Coffee

[57] ABSTRACT

A digger housing having a trencher extendable therefrom is mounted on a truck such that it pivots about two axes. A rod slot having a slanted bottom is dug by pivoting the housing and trencher about the axes. An anchor slot having slanted sides, with one of the sides intersecting the rod slot, is dug by extending the trencher from the repositioned housing. An anchor is buried with an anchor plate in the anchor slot and a rod in the rod slot.

5 Claims, 8 Drawing Figures

Fig. 1
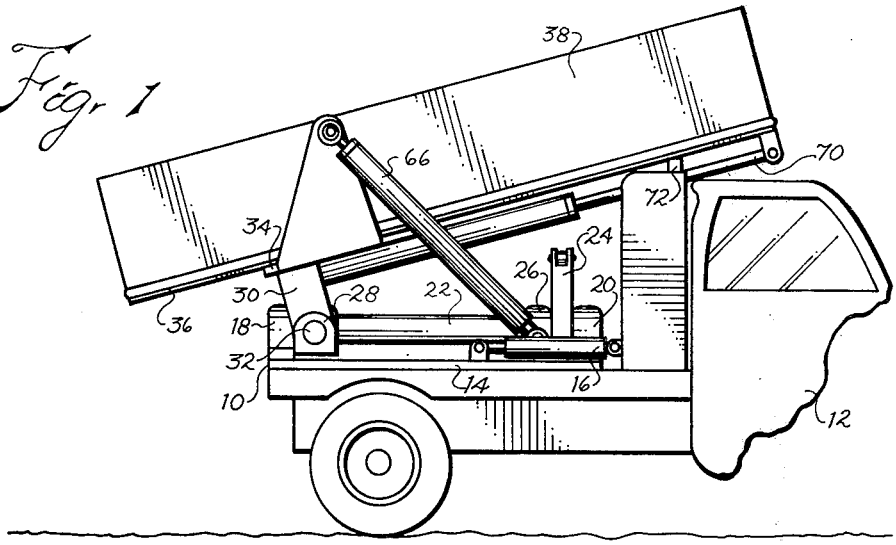
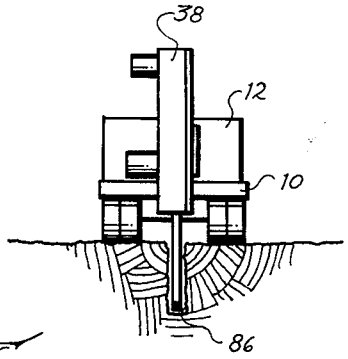
Fig. 3
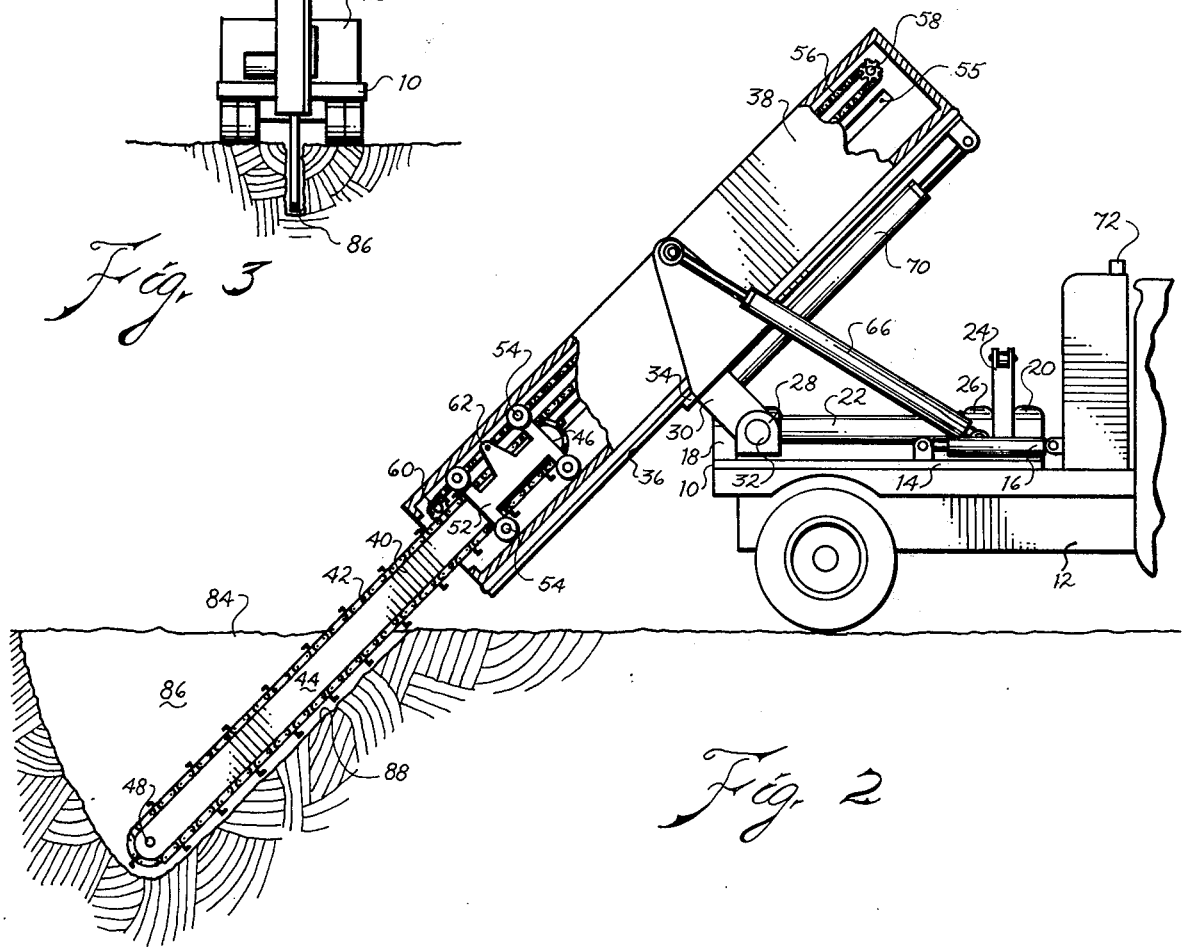
Fig. 2

Fig. 4
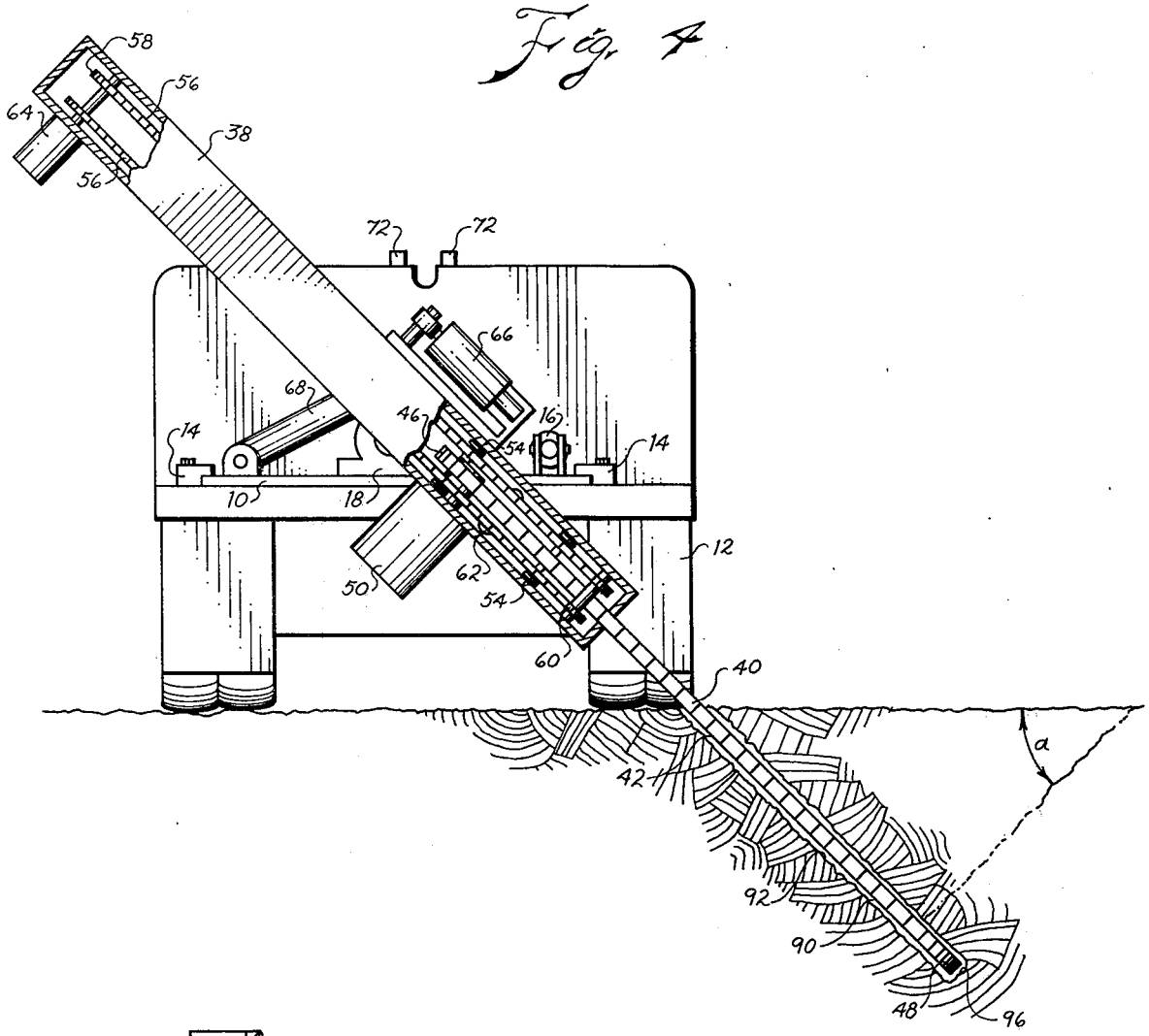
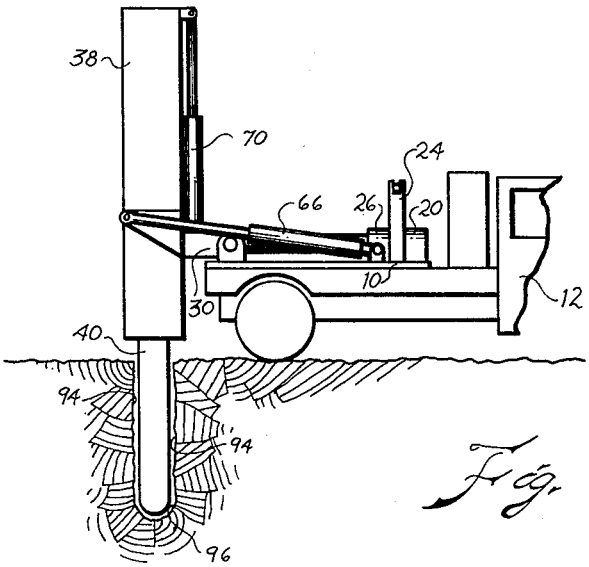
Fig. 5

EXCAVATOR FOR ANCHOR HOLES

CROSS-REFERENCE TO RELATED APPLICATIONS

None. However, applicant filed Disclosure Document No. 059,633 on Apr. 11, 1977, which document concerns this application; therefore, by separate paper, it is respectfully requested the document be retained.

BACKGROUND OF THE INVENTION (1) Field of the Invention

This invention relates to diggers or trenchers (endless chain-driven bucket rotary trenchers), and more particularly to trenchers for digging holes in which to bury anchors for guy wires and the like.

(2) Description of the Prior Art

Before my invention, commercial practice in burying anchors for guy wires and the like was to dig a hole with an auger and place the anchor therein. Such anchors included a rod with an eye attached at one end and a retaining flange or projection at the other end. The anchor was oriented at an angle and large amounts of earth were removed in digging the hole.

The guy wire was attached at the eye. When the anchor was buried in the ground the anchor plate would bear against the surrounding soil to resist pulling of the anchor from the ground. However, anchors buried as described had the disadvantage that the anchor plate was bearing against soil which was disturbed earth and which was manually compacted.

I was aware of the following references prior to filing this application:

Keating; U.S. Pat. No. 1,217,954
Holmes; U.S. Pat. No. 1,635,623
Schmidt; U.S. Pat. No. 2,519,076
Owen; U.S. Pat. No. 2,817,911
Weyers; U.S. Pat. No. 3,315,384
Peck; U.S. Pat. No. 3,388,487
Polinek; U.S. Pat. No. 3,603,010
Wilson; U.S. Pat. No. 3,659,364

SUMMARY OF THE INVENTION

New and Different Function

I have solved the problems previously associated with anchor placement by inventing a hole digger which easily and economically digs a hole within which the anchor bears against undisturbed earth.

My invention has a trencher extendably mounted within a digger housing. The digger housing is pivoted about two axes to orient the trencher.

The digger housing is oriented such that the trencher will dig an anchor slot whose sides are at an angle to the surface of the ground. The trencher is extended from the housing to dig the anchor slot.

To dig the rod slot, the digger housing is pivoted about one of the axes. The trencher digs a rod slot in the ground with vertical sides which perpendicularly intersect the sides of the anchor slot and whose bottom is slanted approximately perpendicular to the sides of the anchor slot.

An anchor is then placed within the hole with a plate on the end of the anchor positioned within the anchor slot and a rod of the anchor positioned within the rod slot. In such a T-shaped slot the anchor plate will bear against undisturbed earth proximate the intersection of the rod and anchor slots.

Therefore, I have invented a hole digger which facilitates the digging of holes in which to bury anchors for guy wires and the like. My invention is more economical in that only an amount of earth sufficient to permit placement of the anchor is removed. An improved anchor placement results because the anchor plate bears against undisturbed earth.

Thus, the total function of my invention is greater than the sum of the functions of its individual parts, i.e., the trencher, hydraulic cylinders, shafts, etc.

OBJECTS OF THE INVENTION

The object of this invention is to bury an anchor.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to adjust, operate, and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWING

FIG. 1 is a side elevational view of an embodiment of my invention mounted upon a truck with the digger in the traveling position.

FIG. 2 is a side elevational view thereof with my invention in position to dig the rod slot.

FIG. 3 is a rear elevational view thereof.

FIG. 4 is a rear elevational view of the truck with my invention in position to dig the anchor slot.

FIG. 5 is a side elevational view thereof.

DESCRIPTION OF THE PREFERRED EMBODIMENT

Figure 6:
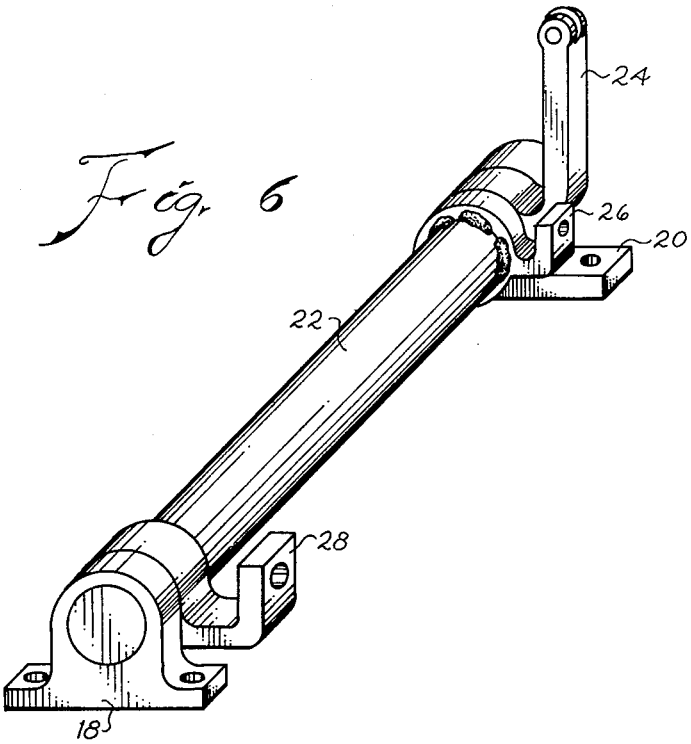
FIG. 6 is a perspective view of the intermediate member and bearings.
Figure 8:
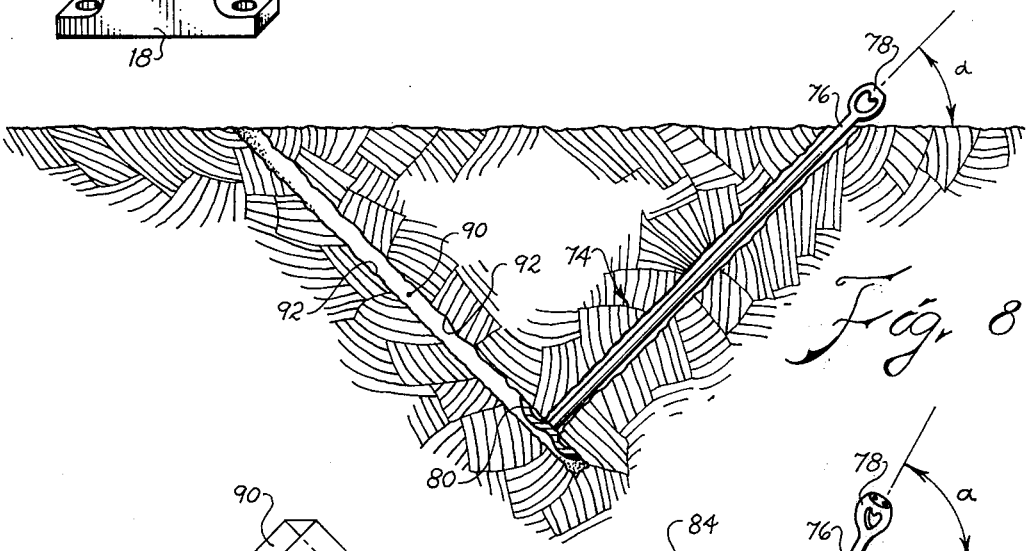
FIG. 8 is a side sectional view thereof with the rod slot partially filled with dirt.
Figure 7:
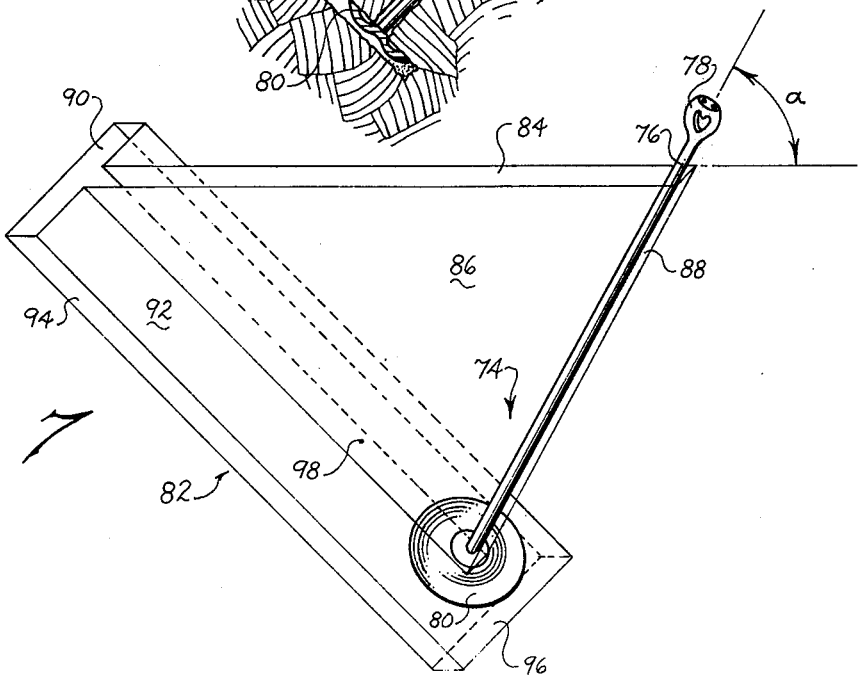
FIG. 7 is a perspective view of an anchor hole with an anchor therein.

Frame 10 in the form of a plate is slidably connected to a mobile platform in the form of truck 12 by frame slides 14. Frame extension motor 16, which is a hydraulic cylinder, interconnects the frame 10 with the truck 12 and provides for longitudinal adjustment of the frame with respect to the truck; i.e., it slides the frame along the platform.

Front bearing 18 and rear bearing 20 are rigidly mounted on the frame 10. Pivot shaft 22 extends through the rear bearing 20 and the front bearing 18 such that the pivot shaft is longitudinal of the truck 12 and journalled within the bearings 18 and 20. Shaft pivot arm 24 and hydraulic arm 26 are rigidly affixed to the pivot shaft 22 proximate the rear bearing 20. Support pivot arm 28 is rigidly attached to the pivot shaft 22 proximate the front bearing 18. The pivot shaft 22, shaft pivot arm 24, hydraulic arm 26, and support pivot arm 28 form an intermediate member. The axis of the pivot shaft 22 is called the frame pivot axis.

Housing support arm 30 is pivoted at its lower end to the support pivot arm 28 by pivot arm 32. The axis of the pin 32 is called the digger pivot axis. Housing track 34 is rigidly attached to the housing support arm 30. Housing slide 36 is rigidly attached to the underside of the digger housing 38. The digger housing 38 is a longitudinal tube having a rectangular cross-section. The housing slide 36 slidably engages the housing track 34 to permit longitudinal adjustment of the digger housing 38 with respect to the housing support arm 30.

Trencher 40 is extendably mounted within the digger housing 38. The trencher is of the endless chain-driven bucket rotary type, having an appearance much as that of a common chain saw. Digger chain 42 is supported by chain plate 44 extending between digger drive sprocket 46 at the upper end of the plate 44 and digger idler sprocket 48 at the lower end of the plate 44. Digger drive motor 50 is connected to the digger drive sprocket 46 and provides for rotary movement of the digger chain 42 within the digger housing 38.

Trencher brace 52, rigidly connected to the digger drive motor 50 and the chain plate 44, supports the trencher 40 within the digger housing 38. The trencher brace 52 has brace rollers 54 at its top and bottom providing for movement of the trencher brace 52 longitudinally within the digger housing 38. The trencher brace 52 and brace rollers 54 bear against the walls of the digger housing 38 to restrain side to side and up and down movement of the trencher 40 and trencher brace 52 within the digger housing 38. The digger housing 38 has digger drive motor slot 55 therein to permit connection of the digger drive motor 50 through the side of the digger housing 38 to the trencher brace 52.

Extension chains 56 extend between extension drive sprockets 58 and extension idler sprockets 60. Brace dogs 62 projecting from the trencher brace 52 engage the extension chains 56. Extension motor 64 connected to the drive sprockets 58 provides for rotary movement of the extension chains 56 around the sprockets 58 and 60 within the digger housing 38.

As the extension chains 56 move within the digger housing 38, the brace dogs 62 and trencher brace 52 will correspondingly move longitudinally within the digger housing 38. In this way, by operation of the extension motor 64, the trencher 40 may be extended from and retracted within the digger housing 38. The housing support arm 30, digger housing 38, and trencher 40 with the elements connected thereto form a digger pivoted to the intermediate member.

Digger pivot motor 66 in the form of a hydraulic cylinder interconnects the upper end of the housing support arm 30 opposite the pivot pin 32 and the hydraulic arm 26. When extended and retracted, the digger pivot motor 66 pivots the digger to the intermediate member about the digger pivot axis.

Frame pivot motor 68 in the form of a hydraulic cylinder interconnects the frame 10 and the shaft pivot arm 24. The frame pivot motor 68 when extended and retracted pivots the digger and intermediate member to the frame about the frame pivot axis.

The frame pivot motor and digger pivot motor are pivot means or positioning means for positioning the elements of the machine about the pivot axes.

Housing slide motor 70 in the form of a hydraulic cylinder interconnects the digger housing 38 and the housing support arm 30. Although I prefer to employ hydraulic cylinders as described above, other motors for pivoting these members could be employed and still be within the scope of my invention.

The frame extension motor 16, housing slide motor 70 and trencher extension motor 64 are each means for respectively positioning the frame on the mobile platform, positioning the digger housing on the housing support arm, and positioning the trencher within the digger housing. The digger motor 50 is a means for driving the chain-driven trencher 40.

In order to provide the necessary mobility of the frame 10 as described previously, I prefer to place the frame 10 and therefore the digger and intermediate members upon a truck. However, other mobile support platforms could be provided.

Because I prefer to place my invention upon the truck 12, for this embodiment the digger housing 38 and trencher 40 must be able to be positioned on the truck 12 to permit travel upon the public roads. This may be accomplished by extending and retracting the appropriate cylinders to bring the digger housing to the position shown in FIG. 1. In this position, the trencher 40 is retracted fully within the digger housing 38, the housing slide motor 70 is extended as far as possible, the frame pivot motor 68 is operated so as to bring the sides of the digger housing 36 approximately vertical, and the digger pivot motor 66 is retracted so as to bring the digger housing 38 into contact with travel brace 72 behind the cab of the truck.

Anchor 74 includes rod 76 along a longitudinal anchor axis, eye 78 in the rod and anchor plate 80. Anchor hole 82 is essentially T-shaped such that the anchor 74 may be placed within it.

The anchor hole 82 includes rod slot 84 and anchor slot 90. The rod slot 84 is defined by vertical parallel sides 86 and slanted bottom 88. The anchor slot 90 has slanted parallel sides 92, vertical ends 94 and bottom 96.

The anchor hole 82 also includes intersection 98 which is the intersection of the rod slot 84 with the anchor slot 90 at the slanted side 92 proximate the rod slot 84. The slanted bottom 88 and the slanted sides 92 may be seen to be approximately perpendicular to one another. In FIG. 4 the rod slot is shown with earth therein except in the immediate vicinity of the anchor rod 76. This is done for clarity so the drawings clearly distinguish and define the anchor slot 90 with the anchor slot sides 92. The slanted bottom 88 is at an anchor angle "a," which is the angle formed by the guy wire and anchor axis with the surface of the ground. Although any desired anchor angle may be used, a common angle in the trade is approximately 45°.

Therefore, when the anchor 74 is to be buried at a given site and a hole need be dug, the functioning of my invention may be seen to occur as follows. The truck 12 is positioned such that the rear of the truck is proximate the anchor site and the frame pivot axis is perpendicular to the projected line of the guy wire, and thus the sides 86.

The digger housing 38 is then pivoted or positioned about the two axes to a position such that the trencher will dig the anchor slot 90. This is accomplished by extending the digger pivot motor 66 until the digger housing 38 is approximately vertical with the ground and then pivoting the digger and intermediate member about the frame pivot axis by retracting the support pivot motor 68 until the digger housing 38 is at an angle perpendicular to the desired anchor angle shown in dotted lines in FIG. 4. The digger drive motor 50 is operated and the trencher 40 is extended from the digger housing 38 by operating trencher extension motor 64, or the digger housing 38 may be adjusted downward by retracting the housing slide motor 70, as preferred, in order to engage the trencher 40 with the ground. The trencher and digger housing are extended until the anchor slot 90 is dug to a desired depth. A desired depth is that depth that is deeper than the projected bottom of the rod slot 84 shown in dotted lines in FIG. 4 of the intersection 98 and permits the rod 76 to lie against the bottom of the intersection 98.

The trencher 40 is then withdrawn from the anchor slot 90 and the truck 12 repositioned such that the frame pivot axis, and therefore the pivot shaft 22, 20 is perpendicular to the previous orientation of the truck 12 and is beneath the projected line of the guy wire.

The digger housing 38 is pivoted or positioned about the two axes such that the trencher 40, when engaged with the earth will dig the rod slot 84. This is accomplished by pivoting the digger about the frame pivot axis by extending the frame pivot motor 68 such that the sides of the housing support arm 30 and the sides of the digger housing 38 are approximately vertical to the ground. The digger pivot motor 66 is then retracted to pivot the housing support arm 30 and digger housing 38 about the digger pivot axis until the trencher 40 may be extended to the opening of the anchor slot 90 without engaging the ground.

The digger drive motor 50 is then operated and the digger pivot motor 66 extended, thereby pivoting the digger housing 38 and trencher 40 through a vertical arc. The trencher is pivoted to dig the rod slot 84 until the bottom thereof is approximately perpendicular to the sides of the anchor slot 90 and approximates the desired anchor angle "a." The trencher 40 is then withdrawn and may now be placed in the traveling position for travel to the next anchor site.

It should be apparent that the order in which the slots are dug is not of critical significance. I have found advantages to digging each slot first. Additionally, the order in which the cylinders are operated to pivot the elements about the digger and frame pivot axes are not critical, and may even be performed simultaneously if desired.

The anchor 74 is finally placed within the anchor hole with the anchor plate 80 in the anchor slot 90 and the rod 76 in the rod slot 84, such that the eye 78 is at or above the surface of the ground. In this position, the anchor plate 80 bears against undisturbed earth at the intersection 98 on either side of the rod slot 84 at the slanted side 92 of the anchor slot 90. The anchor hole 82 is then filled with earth, thereby burying the anchor 74.

As stated previously, the preferred form is to use hydraulic motors not only for the hydraulic cylinders to position the equipment in the correct position, but also as the trencher drive motor 50. However, the hydraulic hoses, valves and pumps to furnish power to all these motors have not been shown for clarity of the drawings. Those with ordinary skill in the art understand how to provide the necessary hoses and controls for hydraulic motors. These rotatable motors could be electric motors and the hydraulic cylinders could be replaced by electric motors with arms and pitmans. However, the more important aspect is to have the motors to control each position.

Thus it may be seen that I have invented an improved hole digger for digging improved anchor holes resulting in improved anchor settings.

As an aid to correlating the terms of the claims to the exemplary drawing, the following catalog of elements is provided:

10 frame
12 truck
14 frame slides
16 frame extension motor
18 front bearing
20 rear bearing
22 pivot shaft
24 shaft pivot arm
26 hydraulic arm
28 support pivot arm
30 housing support arm
32 pivot pin
34 housing track
36 housing slide
38 digger housing
40 trencher
42 digger chain
44 chain plate
46 digger drive sprocket
48 digger idler sprocket
50 digger drive motor
52 trencher brace
54 brace rollers
55 digger drive motor slot
56 extension chains
58 extension drive sprockets
60 extension idler sprockets
62 brace dogs
64 trencher extension motor
66 digger pivot motor
68 frame pivot motor
70 housing slide motor
72 travel brace
74 anchor
76 rod
78 eye
80 anchor plate
82 anchor hole
84 rod slot
86 vertical sides
88 slanted bottom
90 anchor slot
92 slanted sides
94 vertical ends
96 anchor bottom
98 intersection
"a" anchor angle The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. In a machine for digging holes in the ground in which to bury anchors having a rod along a longitudinal anchor axis and an anchor plate projecting outwardly from the anchor rod for impeding longitudinal movement of said anchor when buried, a. said machine including a frame on a mobile platform carrying a digger, b. said digger including an endless chain-driven bucket rotary trencher;

the improved structure comprising in combination with the above:

c. an intermediate member pivoted to the frame about a frame pivot axis, d. said digger pivoted to the intermediate member about a digger pivot axis which is transverse to said frame pivot axis, e. digger pivot means interconnecting the digger and the intermediate member for pivoting said digger about said digger pivot axis, f. frame pivot means interconnecting the intermediate member with said frame for pivoting the intermediate member about said frame pivot axis, g. said frame having
(i) a front bearing mounted thereon, and
(ii) a rear bearing mounted thereon, h. said digger including
(i) a digger housing,
(ii) said trencher being mounted therein,
(iii) a housing support arm having upper and lower ends and being connected to said digger housing, j. said intermediate member including
(i) a shaft pivot arm,
(ii) a hydraulic arm,
(iii) a support pivot arm,
(iv) a pivot shaft, and
(v) said pivot shaft extending through and rigidly connected to said shaft pivot arm, said hydraulic arm, and said support pivot arm, k. said pivot shaft being journalled within said front and rear bearings thus defining the frame pivot axis, m. said digger being pivoted to said intermediate member as defined above by a pivot pin extending through the lower end of said housing support arm and through said support pivot arm with said pivot pin defining the digger pivot axis, n. said digger pivot means interconnecting said hydraulic arm and the upper end of said housing arm, o. said frame pivot means interconnecting said frame with said shaft pivot arm, and p. said digger providing means for digging an anchor hole whereby
(i) said anchor may be slidably placed within the anchor hole, with
(ii) the anchor plate bearing against undisturbed earth.

2. The invention as defined in claim 1 further comprising:

q. said trencher being longitudinally extendable from said digger housing.

3. The invention as defined in claim 1 further comprising:

q. said digger housing having a vertical slide track rigidly connected thereto, r. said housing support arm having a vertical slide frame rigidly attached thereto, s. said vertical slide track slidably engaging said vertical slide frame, t. a housing slide motor interconnecting said digger housing with said housing support arm for longitudinally sliding said digger housing with respect to said housing support arm.

4. The invention as defined in claim 3 further comprising:

u. said trencher being longitudinally extendable from said digger housing.

5. The invention as defined in claim 4 further comprising:

v. said frame being slidably mounted on said mobile platform, w. a frame extension motor interconnecting said frame and said mobile platform for sliding said frame on said mobile platform.

* * * * *